US005165694A

United States Patent [19]

Kraushaar

[11] Patent Number: 5,165,694

[45] Date of Patent: Nov. 24, 1992

[54] PROJECTILE AND TARGET GAME

[76] Inventor: James E. Kraushaar, 9 Pemberton Pl., Laguna Niguel, Calif. 92677

[21] Appl. No.: 908,086

[22] Filed: Jul. 6, 1992

[51] Int. Cl.[5] ..... A63B 67/00

[52] U.S. Cl. ..... 273/343

[58] Field of Search ..... 273/343, 327, 338

[56] References Cited

U.S. PATENT DOCUMENTS

| | | | |
|---|---|---|---|
| 1,520,082 | 12/1924 | Purnell | 273/343 |
| 2,131,332 | 9/1938 | Rose | 273/343 |
| 2,408,160 | 9/1946 | Brunner | 273/343 X |
| 2,797,924 | 7/1957 | Stewart | 273/343 |
| 3,701,531 | 10/1972 | Bowers | 273/343 |
| 3,774,911 | 11/1973 | Benfield | 273/343 |
| 3,814,428 | 6/1974 | Foley | 273/343 |
| 4,487,419 | 12/1984 | Welbourn | 273/343 |

FOREIGN PATENT DOCUMENTS

| | | | |
|---|---|---|---|
| 347953 | 5/1931 | United Kingdom | 273/343 |

*Primary Examiner*—Paul E. Shapiro

*Attorney, Agent, or Firm*—Francis X. LoJacono

[57] ABSTRACT

A target-game device comprising a target-support housing having a rear wall and a pair of forwardly extending side walls, a plurality of target crossbars being mounted between the side walls, and spaced one above the other to provide a plurality of target rungs for projectiles that are thrown for scoring as the projectiles are caught on the marked portions of the target rungs which represent various point values.

9 Claims, 1 Drawing Sheet

FIG. 1
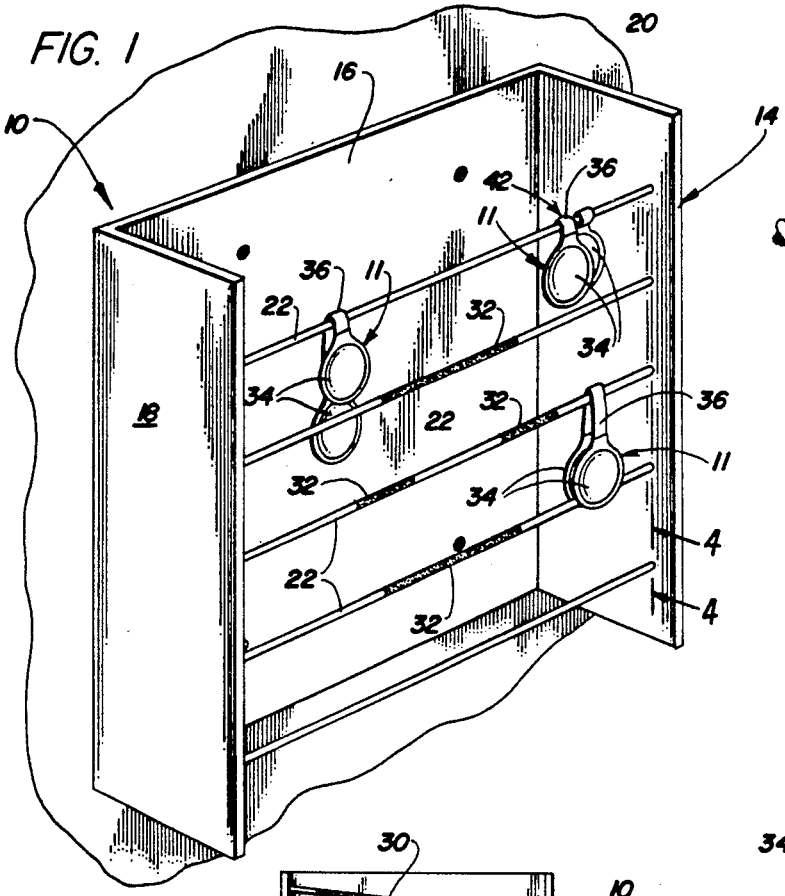
FIG. 4
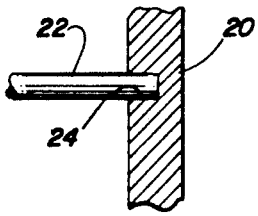
FIG. 3
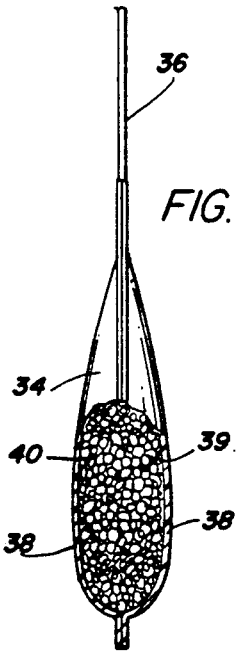
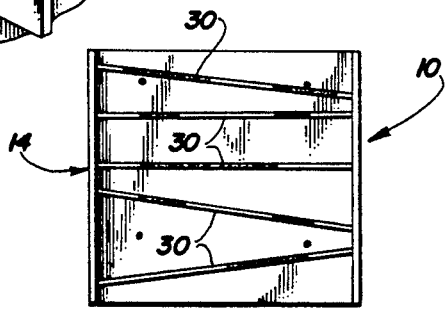
FIG. 5
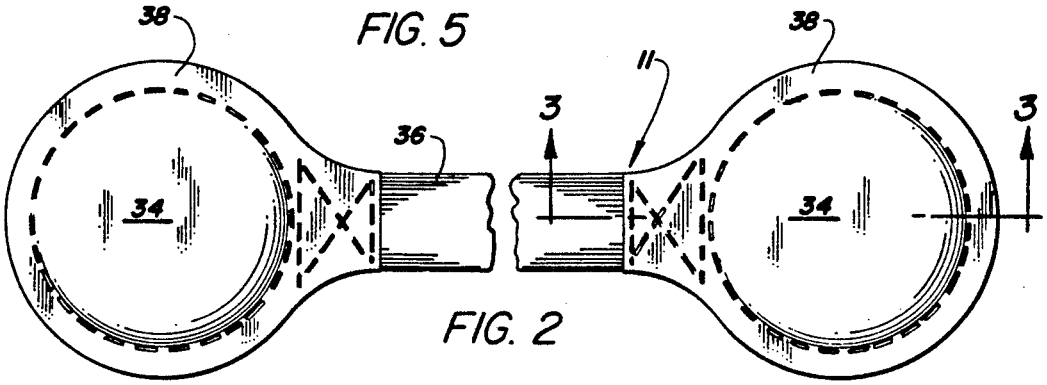
FIG. 2

PROJECTILE AND TARGET GAME

BACKGROUND OF THE INVENTION

1. Field of the Invention

The present invention relates generally to a projectile and target game, and more particularly to a game that includes a plurality of projectiles defined by a pair of weighted bag-like sacks that are interconnected by an elongated stretchable web member, and are adapted to be thrown or tossed so as to be caught on one of several target members that are horizontally mounted to a housing unit which is arranged to be mounted to a wall or a like fixed structure.

2. Description of the Prior Art

As is well known in the art, there are several types of projectile throwing games with having their own unique structures for playing the game under specific rules so as to create a challenge to the skill of the player or players. Since these particular games include a tossing device as well as targets to correspond to the tossing device, such games generally have various limitations that restrict their use as well as the area in which the game may be played. That is, many such games are limited in that they can only be played outdoors, and they require a considerably large game area. Other types of similar games are designed for use indoors. Some types of games of this sort are complicated to use and expensive due to their structures and related equipment that is necessary for the operation of the games.

As examples of some of the known games that are designed for throwing projectile-type devices, one may refer to any of the following U.S. patents.

There is disclosed in U.S. Pat. No. 2,797,924 to Victor N. Stewart a game designed for use outdoors that employs a throwing device comprising a pair of frustoconical weights made of semi-resilient plastic materials that are connected together by a rope and chain. The target is a single bar member mounted to a floor support frame.

In U.S. Pat. No. 3,701,531 to J. L. Bowers there is disclosed an elastic ball projectile including a tree-like target defined by a vertical trunk with sidewardly extending branches, over which the ball projectile is tossed in an attempt to hook it when thrown.

In U.S. Pat. No. 3,717,348 to J. L. Bowers, there is disclosed a hand-held projecting unit that is used to catch a ball.

U.S. Pat. No. 3,814,428 to C. F. Foley discloses a game apparatus comprising targets and missiles, the missiles each comprising a pair of weighted bags joined by a flexible web, and each target comprising a stake having an arm member extending outwardly from the stake adjacent its upper end, and wherein the missile is thrown so as to be caught on the arm member.

OBJECTS AND ADVANTAGES OF THE INVENTION

It is an object of the present invention to provide a projectile and target game having a throwing device comprising a pair of weighted bags that are connected by a web so as to engage various target members which are defined by a plurality of horizontally positioned crossbar members that are mounted between the projecting side walls of a wall-support housing.

Another object of the invention is to provide a game of this character wherein each of the crossbar members is marked or painted with a specific color so as to designate a different scoring value.

Still another object of the invention is to provide a game of this character wherein the web member is provided with a sufficient length so that when caught on a cross bar it can wrap around one or two cross bars at the same time. The various positions as well as the way in which the throwing unit is caught determine the overall score of the player or players.

A further another object of the invention is to provide a game of this type that is relatively inexpensive to manufacture, is easy to mount and maintain, and is rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Novel features and advantages of the present invention, in addition to those mentioned above, will become apparent to those skilled in the art from reading the following detailed description in conjuction with the accompanying drawings and numbered parts wherein:

FIG. 1 is a pictorial view of the present invention showing the crossbar support housing mounted on a wall and having a plurality of projectile units illustrated in various arrangements and supported on some of the cross bar members;

FIG. 2 is an enlarged plan of one of the projectiles with the elastic web broken away;

FIG. 3 is a cross-sectional view taken substantially along line 3—3 of FIG. 2 wherein the sack portion is shown filled with suitable material to provide weight to the projectile;

FIG. 4 is an enlarged cross-sectional view taken substantially along FIG. 4—4 of FIG. 1; and FIG. 5 is a front-elevational view showing an alternative arrangement of the present invention.

DETAILED DESCRIPTION OF THE INVENTION

Referring now to the drawings in detail and more particularly to FIG. 1, there is illustrated a target-game device, generally indicated at 10, and a plurality tossing projectiles 11. The target game device comprises a target housing 14 that is secured to a wall 12 or any suitable fixed support structure capable of supporting the target housing which is formed having a rear supporting wall 16 and a pair of side wall members 18 and 20. Side walls 18 and 20 are preferably removably attached to rear supporting wall 16 in any suitable manner and may be fabricated from a wood product or any suitable plastic material. However, it should be noted that housing 14 can be molded as a single integral unit, if so desired.

Target housing 14 includes a plurality of target crossbar members defined by target rungs 22 that are horizontally positioned between side walls 18 and 20 and forward of said rear wall 16 to allow a thrown projectile to wrap around an engaged target rung. The ends of the crossbar members are fixedly mounted to each side wall, and the end portions 24 of the crossbars are received in recesses 26, as illustrated in FIG. 4, the recesses being positioned vertically one above the other and adjacent the forward edge 28 of each side wall. The present invention is shown having four horizontally arranged target crossbar members. However, any number of target crossbar members may be used to play the game. An alternative arrangement is also contemplated wherein the target crossbar members or rungs 30 are placed in various horizontal and inclined positions relative to each other, as indicated in FIG. 5.

In order to establish a scoring means for players to score points during the game, various target areas are provided with indicia, such as color-coded markings that are affixed to each of the target crossbar members by painting or other suitable means, as indicated at numeral 32 in FIGS. 1 and 5. These markings may be placed randomly along each rung and may also vary in size so as to create a challenging game for one or more players, and to also allow for more than one set of playing rules to be selected by the participating players.

Each tossing projectile 11 comprises a pair of identical weighted bags 34 that are affixed to the opposite ends of a web member 36. Each bag 34 is formed by two sheets of soft material 38 such as a suitable fabric or soft vinyl film that are either sewn or sealed together about their peripheral edges, whereby a sealed compartment 39 is defined. Also, each compartment is filled with a heavy material, indicated at numeral 40. Various suitable weighted materials can be readily employed, such as sand or gravel, but preferably lead or steel shot. The bags are shown as being circular in configuration but can be made having one of many suitable configurations. Web member 36 is not only made from a flexible material but is preferably formed from an elastic band which can stretch when the web engages a target crossbar. Stretching causes the distance between the weighted bags to extend and then slacken, whereby the action of the projectile becomes unpredictable. That is, the projectile will sometimes wrap around the engaged rung, as indicated at 42 in FIG. 1, or will slip downwardly from one rung to a lower rung or drop from the target area, in which case the player does not score.

Preferably, target housing 14 should be mounted to a fixed structure, waist or shoulder high with the player standing from ten to twenty-five feet away. However, the standing distance from the target crossbar members can vary to suit the skilled or unskilled player or players. Accordingly, the present game provides a challenge not found in known similar projectile-type games.

It may thus be seen that the objects of the present invention set forth herein, as well as those made apparent from the foregoing description, are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A target-game device comprising:

a target housing defined by a rear support wall and pair of outwardly extending side walls;

a plurality of target crossbar members fixedly positioned between said side walls and spaced one above the other, wherein each target crossbar defines a target rung;

means for scoring formed on each of said target rungs; and a plurality of projectiles, each formed by a pair of identically weighted bags interconnected by an elongated flat, elastic, web member which allows said projectile to engage and catch on one or more of said target rungs.

2. A target-game device as recited in claim 1, wherein said scoring means is defined by applying indicia selectively to each of said target rungs.

3. A target-game device as recited in claim 1, wherein said scoring means is defined by applying indicia selectively to each of said target rungs, said indicia being defined by color-coded markings, wherein each of said color-coded markings is provided with a given score rating, whereby points are awarded to a player of said target game.

4. A target-game device as recited in claim 3, wherein said color-coded markings are randomly positioned along one or more target rungs.

5. A target-game device as recited in claim 4, wherein one or more of said color-coded markings are applied along the length of said target rung.

6. A target-game device as recited in claim 5, wherein each of said elastic bands stretches longitudinally when said web engages one of said target rungs, whereby the stretching of the web causes the distance between the weighted bags to extend and then slacken, whereby the action of the projectile becomes unpredictable.

7. A target-game device as recited in claim 5, wherein said target rungs are positioned in various horizontal and inclined positions relative to each other.

8. A target-game device as recited in claim 5, wherein said target housing includes means for mounting said target housing to a fixed structure.

9. A target-game device as recited in claim 5, wherein said target rungs are mounted adjacent the forward portion of said outwardly extending side walls, whereby said rear wall is spaced rearwardly thereof to allow said projectiles to freely wrap around said target rungs.

* * * * *